United States Patent [19]

Edgley

[11] Patent Number: 4,712,848

[45] Date of Patent: Dec. 15, 1987

[54] EDGE BOARD CONNECTOR WITH POSITIVE BOARD LOCK

[75] Inventor: Richard Edgley, Elmhurst, Ill.

[73] Assignee: Molex Incorporated, Lisle, Ill.

[21] Appl. No.: 853,314

[22] Filed: Apr. 17, 1986

[51] Int. Cl.[4] ..... H01R 9/09

[52] U.S. Cl. ..... 439/327; 439/350

[58] Field of Search ..... 339/75 MP, 91 R, 176 MP

[56] References Cited

U.S. PATENT DOCUMENTS

| | | | |
|---|---|---|---|
| 2,802,188 | 8/1957 | Badders | 339/176 MP |
| 2,937,357 | 5/1960 | Kennedy | 339/176 MP |
| 3,289,148 | 11/1966 | Antes | 339/176 MP |
| 3,932,016 | 1/1976 | Ammenheuser | 339/75 MP |
| 3,970,353 | 7/1976 | Kaufman | 339/176 MP |
| 4,136,917 | 1/1979 | Then et al. | 339/91 R |
| 4,575,172 | 3/1986 | Walse et al. | 339/176 MP |
| 4,576,427 | 3/1986 | Verbruggen | 339/176 MP |

FOREIGN PATENT DOCUMENTS 2562338 10/1985 France .

*Primary Examiner*—John McQuade

*Attorney, Agent, or Firm*—John W. Cornell; Louis A. Hecht

[57] ABSTRACT

An electrical connector is disclosed for making electrical connections to printed circuit boards. The electrical connector contains a latch apparatus for securing the printed circuit board to the connector. The latch apparatus is comprised of two latches which cooperate with slots disposed on opposite edges of the printed circuit board to the connector. The separate latches are mechanically connected together by a bail member. Release of the latch is accomplished rather easily without the exertion of any harmful forces parallel to the printed circuit board, which may be harmful to another printed circuit board to which the connector may be fastened. The latch is released by inserting a flathead screwdriver into an opening defined by the bail member and the rear wall of the connector housing. Slightly turning the screwdriver in either direction will release the latch.

3 Claims, 3 Drawing Figures

EDGE BOARD CONNECTOR WITH POSITIVE BOARD LOCK

BACKGROUND OF THE INVENTION

1. Field of the Invention

This invention relates generally to edge board connectors and more particularly to electrical connectors having locking means adapted to releasably secure printed circuit boards having electrical conducting strips disposed along one edge.

2. Description of the Prior Art

Electrical connectors for making connections to printed circuit boards are generally known in the art. An example of such an electrical connector is disclosed in U.S. Pat. No. 2,928,063 to Gammel.

These connectors, generally known in the art as edge connectors, are adapted to make electrical connections to a printed circuit board having a plurality of parallel conducting strips along one edge. Once the edge of the printed circuit board is inserted into the connector, spring contact terminals within the connector housing exert a force against the conductive strips on the printed circuit board to ensure a tight connection. However, such connections may become loose due to vibration and jarring causing interruption of the electrical circuit in which the connector is used.

Others have tried to solve this problem by various means. U.S. Pat. No. 4,416,496 to Brefka discloses an anchor for securing a printed circuit board to a connector. In this apparatus, two anchors are used, each fastened to an end of the connector by a screw. Each anchor contains a pin perpendicular to the printed circuit board, adapted to be inserted into a hole in the printed circuit board. However, this type of arrangement is only adaptable for making connections between two printed circuit boards in a side by side configuration. Moreover, due to the separate pieces, this type of arrangement would be expensive to manufacture and rather cumbersome to assemble.

Another method of securing a printed circuit board to a connector is disclosed in a French Pat. No. 2,562,338. In this connector assembly, a latch means is used to secure theth printed circuit board to the connector. The latch means is formed from a portion of the back wall of the housing by making two parallel slits in the back wall of the housing perpendicular to the axis of the housing, each slit extending the height of the housing. That portion disposed between the slits is then free to be pulled away from the housing. A tab is formed on the top portion of the latch means and is received into a slot on a printed circuit board. The printed circuit board is removed by pulling the latch means away from the back wall of the housing. However, in such a design the force required to release the latch results in a torque about the connector housing axis resulting in a considerable force in a direction parallel to the plane of the printed circuit board. Because of this force, such a latching means may not be suitable for applications where the connector is rigidly attached to another printed circuit board. In such applications this force may cause damage to the printed circuit board to which the connector is attached or to the connections between the housing and that board.

SUMMARY OF THE INVENTION

It is thus an object of the present invention to overcome the problems of the electrical connectors in the prior art.

It is another object of the present invention to provide an electrical connector for making secure connections between an electrical connector and a printed circuit board.

It is a further object of the present invention to provide an electrical connector which is not expensive to manufacture.

It is yet another object of the present invention to provide an electrical connector which is not cumbersome to assemble.

It is a further object of the present invention to provide a secure electrical connector which can be released without exerting any appreciable force upon a printed circuit board to which the connector may be fastened.

Briefly the present invention relates to an electrical connector for a printed circuit board having an elongated slot for receiving an edge portion of the printed circuit board to be connected. The printed circuit board edge portion comprises a plurality of conducting strips disposed generally in parallel and equally spaced along an edge. Disposed within the connector housing is a plurality of resilient contact members each adapted to make electrical connection with one of a plurality of the conducting strips. The connector housing contains a latch means for releasably securing the printed circuit board to the connector. The latch means is integral to the connector housing and is received by slots disposed on the printed circuit board for ensuring a secure connection. The latch means may be released without the exertion of any appreciable force in a direction parallel to the plane of the printed circuit board. Thus forces which may cause damage to another printed circuit board to to solder connections between the connector and that board are eliminated.

More particularly, the connector of the present invention comprises an elongated electric housing with a cavity formed along its length with an opening for receiving the mating edge of a daughter printed circuit board. A plurality of terminals are mounted in the housing cavity, and each terminal has one end adapted to engage a daughter board circuit and another end adapted to contact a mother board circuit. Means are provided on the housing for mounting the connector to the mother board. The connector also includes latching means integrally formed on the housing for releasably securing the daughter board to the connector. In accordance with the present invention, an improved connector arrangement is provided by including a latch receiving cut out in the daughter board disposed near or adjacent its mating edge. Moreover, an improved means is provided in the form of a resilient vertical arm member disposed within the cavity hingeably connected to the rear wall of the dielectric housing. The vertical arm member is provided with a forwardly extending latch tab adapted to be received within the cut out of the daughter board and further includes a manipulable actuator opposite the tab adapted to engage an actuating tool. The improved latching means is moveable between a normal closed vertical position wherein the tab is received within the cut out and a release position wherein the tab is retracted from the cut out. The new and improved latch assembly of the present invention is actuable by rearward movement of the actuator from a closed position to a release position to permit insertion or withdrawal of the mating edge of the daughter board into the cavity of the connector through the opening provided therein.

BRIEF DESCRIPTION OF THE DRAWING

The above and other objects and advantages of the present invention will become apparent from the following detailed description of the preferred embodiment of the present invention illustrated in the accompanying drawing wherein.

DETAILED DESCRIPTION

Figure 1:
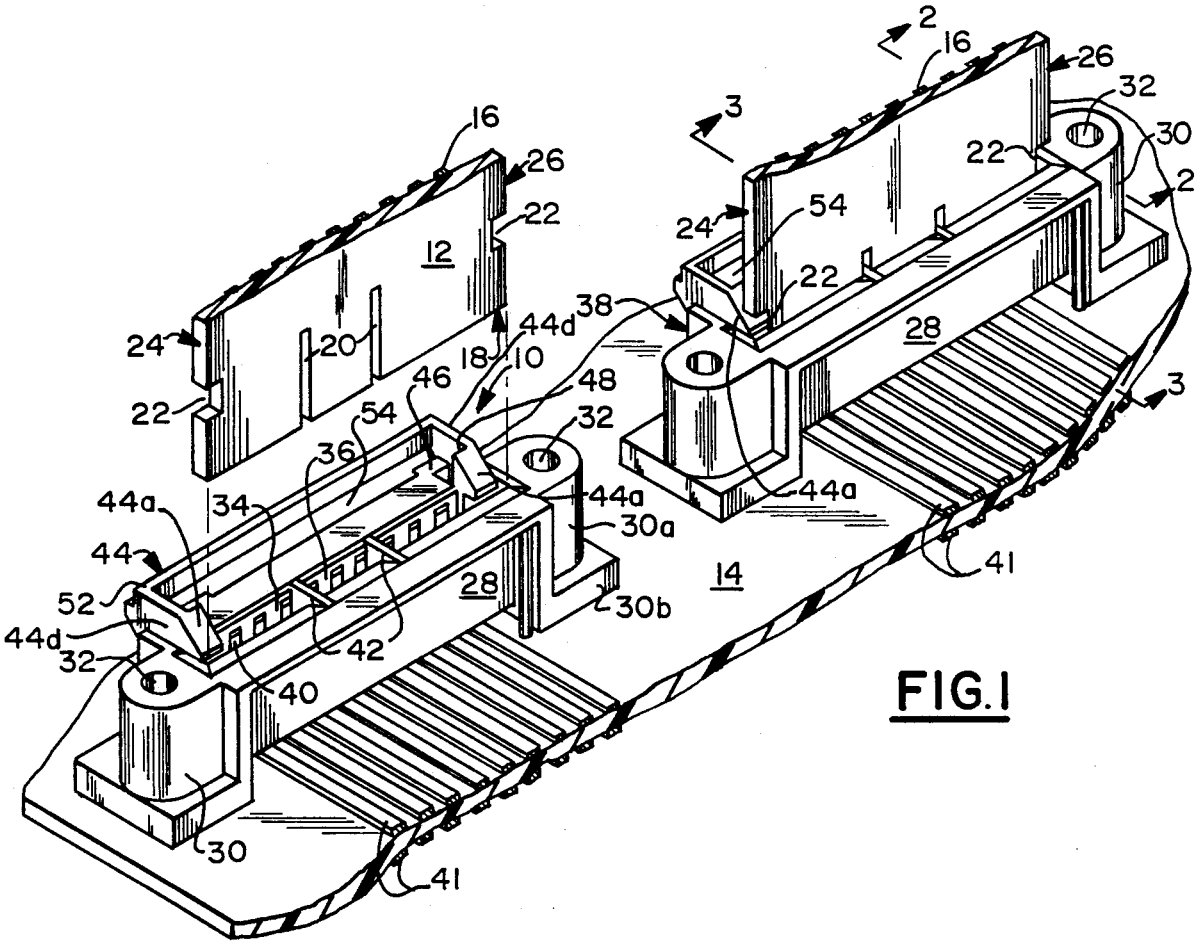
FIG. 1 is a perspective view of an electrical connector in accordance with the present invention.

Referring now to the drawing, an electrical connector assembly incorporating the present invention is generally shown as 10 in FIG. 1. The connector 10 is of the type intended for interconnecting a plurality of electrical components on a printed circuit board, such as 12, with other circuitry, such as another printed circuit board 14, disposed in electrical or electronic apparatus. The advantage of such an approach is that the printed circuit board 12 may be fabricated as a separate and independent module and incorporated in the intended apparatus whenever appropriate or convenient without additional soldering or other assembly steps being required. Moreover, the module may be conveniently removed for servicing or replacement at any time after assembly.

As shown in FIG. 1, the printed circuit board 12 is intended to be illustrative of printed circuit boards adapted for use with the electrical connector 10 of the present invention. The printed circuit board 12 includes a substrate with a plurality of conductive strips 16 disposed generally parallel and equally spaced along one edge 18 of the printed circuit board 12. These conductive strips 16 are connected to components or other circuitry (not shown). The board edge 18 may be slightly beveled to facilitate insertion into the connector 10.

The printed circuit board 12 has a pair of elongated slots 20 extending from one edge 18 along a first axis in the plane of the printed circuit board 12. These slots 20 cooperate with key members disposed within the electrical connector housing 10 to ensure proper registry of the conductor strips 16 when the printed circuit board 12 is inserted into the electrical connector 10. Another pair of slots or cut-outs 22 is disposed on opposite edges 24 and 26. Each of these slots 22 extend from oppositely disposed edges 24 and 26 along a second axis in the plane of the printed circuit board 12, perpendicular to the first axis. These slots 22 cooperate with the connector latch of the present invention to provide a secure connection between the printed circuit board 12 and the electrical connector 10.

The connector 10 of the present invention includes a housing 28 formed by an injection molding process and made from a glass filled polyester resin material. However, other materials and manufacturing techniques may be used in the practice of the present invention. The non-electrically conductive portions of the electrical connector 10 are integrally formed to provide a one-piece construction.

Disposed at each end of the housing 28 is a mounting flange 30. The mounting flanges 30 are generally comprised of cylindrical members **30*a* disposed on a generally rectangular base 30*b*. Each contains an aperture 32 extending axially through the flange. The apertures 32 are threaded for receiving a mounting screw (not shown) to fasten the electrical connector to a printed circuit board 14**.

The generally rectangular base 30b of the mounting flange 30 is slightly lower in elevation than the rest of the connector housing 28 to provide a slight gap between the conductive strips of the printed circuit board 14 and the connector housing 28 when the electrical connector 10 is fastened to the printed circuit board 14. This prevents wicking of molten solder when connector 10 is mounted on and connected to printed circuit board 14.

Housing 28 contains an elongated, axially extending cavity 34 sized to be somewaht larger than the edge 18 of the printed circuit board 12. A plurality of ribs 36 are disposed generally in parallel and equally spaced along the back wall 38 of the cavity 34. The compartments defined between adjacent ribs 36 receive electrical spring contacts 40 used to form an electrical connection with the conductive strips 16 of the printed circuit board 12.

Figure 3:
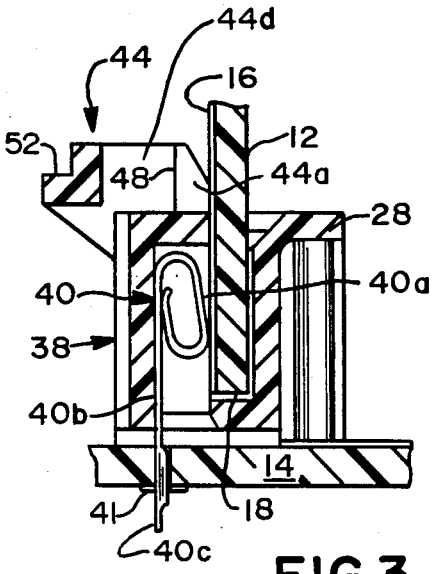
FIG. 3 is a fragmentary cross-sectional view of the electrical connector of FIG. 1 taken along line 3—3 illustrating the connector latch in the latched position.

As best illustrated in FIG. 3, the electrical spring contacts 40 are stamped and integrally formed of an electrically conductive resilient material, such as a strip of phosphor bronze alloy #521 having a thickness of approximately 0.027 millimeters. One spring contact 40 is disposed in each of the compartments. The spring contacts 40 are inserted into the connector housing 28 through apertures (not shown) on the bottom of the housing 28. Consequently, individual spring contacts 40 may also be removed and replaced after fabrication.

Each spring contact 40 has an arcuate spring portion **40*a*, a straight portion 40*b* and a terminal portion 40*c*. As illustrated in FIG. 3, the straight portion 40*b* extends below the base of the housing 28 and defines portions 40*c* for connection to strips 41 disposed on the printed circuit board 14. More specifically, the terminal portion 40*c* is inserted into plated through holes (not shown) on the printed circuit board 14 and soldered to the printed circuit board 14** by conventional means, such as wave soldering.

Upon insertion of the printed circuit board 12 into the cavity 34 of the connector assembly 10, the arcuate portion **40*a* of each of the spring contacts 40 makes electrical connection with one of the conductive strips 16 disposed on the printed circuit board 12. Portion 40*a* of the spring contact may be plated with a 60% tin-lead alloy having a thickness of approximately 0.0025 millimeters or more. This coating provides for good electrical contact between each of the spring contacts 40 and the terminal strips 16 disposed on the printed circuit board 12**.

During insertion of the printed circuit board 12 into the electrical connector 10, the resilient spring contacts 40 are deflected to allow the printed circuit board 12 to travel into the housing 28. Once the printed circuit board 12 is secured, the resiliency of the spring contacts 40 exerts a force on the conductive strips 16 and urges the printed circuit board 12 away from the rear wall 38 of the housing 28. This force, typically between 2 and 6 newtons, insures a good electrical connection between the conductive strips 16 of the printed circuit board 12 and the spring contacts 40.

Referring back to FIG. 1, key members 42 are disposed within the cavity 34 transverse to the axis of the cavity 34 joining the two elongated opposite walls of the connector housing 28. These key members 42 extend to the base of the housing 28 an are adapted to cooperate with the slots 20 in the printed circuit board 12 to ensure proper registry between the conductive strips 16 on the printed circuit board 12 and the spring contacts 40. These key members 42 also provide mechanical strength to the housing. Moreover they prevent over-travel of the printed circuit board 12 into the connector 10.

Figure 2:
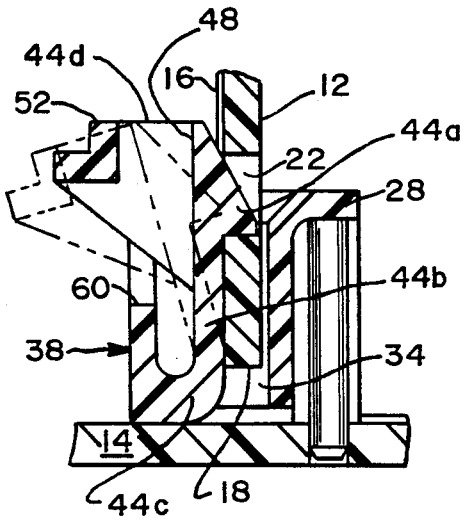
FIG. 2 is a fragmentary cross-sectional view of the electrical connector of FIG. 1 taken along line 2—2 of FIG. 1 illustrating the connector latch in the latched position in solid lines and in the release position in phantom.

Disposed adjacent the ends of the cavity 34 and contiguous to the ribs 36 are latch means 44 cooperating with slots 22 to secure the printed circuit board 12 to the electrical connector 10. As best illustrated in FIG. 2, latch means 44 is formed integral with the connector housing 28 and is comprised of a latch tab 44*a*, a vertical arm 44*b*, a hinge portion 44*c* and a rearwardly extending actuator 44*d*. The hinge portion 44*c* of the latch 44 is integrally formed and hinged to the bottom of the back wall 38 of the connector housing 28.

The actuator 44*d* is of a general polygonal shape and rearwardly extends beyond rear wall 38 to the outside of the connector housing 28 through slots 60 in the rear wall 38 of the connector housing. Slots 60 extend downward from the top of the rear wall 38 of the connector housing 28 and function as guides for the latch 44.

Rearward travel of latch means 44 is restricted by a stop means formed between the inner surface 46 of rearwall 38 immediately adjacent slot 60 and the rearward surface 48 of vertical arm member 44*b* immediately adjacent actuator 44*d*. When the latch means 44 is actuated towards the release position, the contact surface 48 abuts against rear wall surface 46 to restrict further rearward travel of the latch means 44.

As best shown in FIG. 1, the latches 44 are disposed within cavity 34, adjacent the ends thereof and are integrally formed with a bail member 52. The bail member 52 serves to mechanically interlock the two latches. Thus to release the latches, the bail member 52 must be urged in a direction away from the rear wall 38 of the connector housing 28. Travel by the bail member 52 in this direction will retract the latches 44 to the release position as shown in phantom in FIG. 2.

As heretofore stated, appreciable forces parallel to the plane of the printed circuit board may cause damage to a printed circuit board, such as 14, to which the connector 10 is fastened, and/or to the solder connection. In accordance with the present invention, no such harmful forces are required to release the latches of connector 10. The latches 44 of the present invention are retracted to the release position by inserting a suitable tool such as a screwdriver or the like into an opening or gap 54 defined between the bail member 52 and the rear wall 38 of the housing 28. The tool is inserted far enough into the opening 54 such that one side can contact the rear wall 38 of the housing 28 and the other side can contact the bail member 52. By turning the tool in either direction the bail member 52 is urged away from the rear wall of the connector housing 28 thus retracting the latches 44 to the release position as shown in phantom in FIG. 2. By such operation, no torque is developed about the axis of the connector housing and consequently no harmful forces in a direction parallel to the plane of the printed circuit board 12 are applied to the printed circuit board 14. The reaction force from operating the latch is applied through the tool to the rear wall 38. These forces are balanced and little force or torque need be applied between the connector 10 and board 14. Any forces that might result are lateral forces applied to the connector housing 28 generally absorbed by the mounting screws used to fasten the connector 10 to the printed circuit board 14.

Accordingly, a printed circuit edge board connector has been disclosed having a latch for securing a printed circuit board to an electrical connector. Once the printed circuit board has been inserted into the connector and latched in place, the latches can be released quickly and easily by a tool such as a screwdriver without transmitting any harmful force to another printed circuit board to which the connector is fastened or to the solder connections. The latch is integral with the connector housing which makes it economical to fabricate.

While only certain embodiments have been herein illustrated and described, it will of course be understood that various modifications and alternate constructions may be made without departing from the true scope and spirit of the invention. It is understood that the appended claims are intended to cover all such modifications and alternate constructions as fall within their true scope and spirit.

I claim:

1. A connector for electrically connecting circuits on mother and daughter printed circuit boards, said connector including an elongate dielectric housing with a cavity formed along its length with an opening for receiving said daughter board mating edge and defining opposed front and rear walls in said housing, a plurality of terminals mounted in the housing, each terminal having one end adapted to engage a daughter board circuit and another end adapted to contact a mother board circuit, means on the housing for mounting the connector to said mother board, and latch means formed on the housing for releasably securing said daughter board to said connector, the improvement comprising:

said daughter board including a plurality of latch-receiving cut-outs disposed near said mating edge;

said integral latch means being a latch assmebly including a corresponding plurality of resilient vertical arm members spacedly disposed within the cavity, each vertical arm member hingeably connected to said rear wall having a forwardly extending latch tab adapted to be received within a cut-out of the daughter board and a manipulable actuator opposite the tab, said actuators being mechanically interconnected by a integrally formed bail bar, said bail bar being disposed outside of the housing in parallel spaced relation to said rear wall to define a tool receiving gap therebetween, said latch assembly being moveable between a normal closed vertical position wherein said tabs are received within said cut outs and a release position wherein said tabs are retracted from said cut-outs, whereby said latch assembly is actuable by rearward movement of said bail bar from a closed position to a release position to permit insertion or withdrawl of said mating edge into the cavity through said opening.

2. A connector as defined in claim 1 wherein said rear wall includes open slots extending therein and said actuators extend from said vertical arms through said slots to said bail bar.

3. A connector as defined in claim 1 wherein said housing further includes at least one integrally formed transverse key member in said cavity connecting the front and rear walls for mechanically strenghtening the housing; and said daughter board mating edge including at least one corresponding mating slot disposed therein adapted to slideably engage said day member for ensuring registration between corresponding circuits on said daughter board and terminals in the cavity.

* * * * *